US007832218B2

(12) United States Patent
Hawkins

(10) Patent No.: US 7,832,218 B2
(45) Date of Patent: Nov. 16, 2010

(54) HIGH EFFICIENCY APPARATUS AND METHOD FOR COOLING PRODUCE

(76) Inventor: Scott Anthony Hawkins, 161 Hidden Valley Rd., Royal Oaks, CA (US) 95076

( * ) Notice: Subject to any disclaimer, the term of this patent is extended or adjusted under 35 U.S.C. 154(b) by 565 days.

(21) Appl. No.: 11/273,956

(22) Filed: Nov. 14, 2005

(65) Prior Publication Data

US 2007/0017233 A1 Jan. 25, 2007

Related U.S. Application Data

(60) Provisional application No. 60/627,388, filed on Nov. 12, 2004.

(51) Int. Cl.
*F25D 13/06* (2006.01)

(52) U.S. Cl. ..... 62/63; 62/378

(58) Field of Classification Search ..... 62/63, 62/2, 237, 378, 239, 65, 408; 52/173.2
See application file for complete search history.

(56) References Cited

U.S. PATENT DOCUMENTS 3,020,596 A * 2/1962 Clapp et al. ..... 264/522
3,419,969 A * 1/1969 Freze ..... 34/126
3,939,614 A * 2/1976 Frommelt et al. ..... 52/2.13
4,474,020 A 10/1984 Freeman
4,532,774 A 8/1985 Burns
4,736,592 A 4/1988 Ohling
4,802,734 A * 2/1989 Walter ..... 359/443
5,341,613 A * 8/1994 Brockman et al. ..... 52/173.2
5,553,424 A * 9/1996 Brockman et al. ..... 52/2.12
6,128,862 A * 10/2000 Katz ..... 52/2.11
6,205,721 B1 * 3/2001 Ashelin et al. ..... 52/173.2
6,334,330 B2 * 1/2002 Lang et al. ..... 62/374
6,481,505 B2 * 11/2002 Beck et al. ..... 166/387
6,823,905 B1 * 11/2004 Smith et al. ..... 141/68

FOREIGN PATENT DOCUMENTS

DE 19652166 A1 * 6/1998
JP 8-313162 A * 11/1996

OTHER PUBLICATIONS

Abstract of JP 8-313162 A to Iwata et al.*
Translation of JP 8-313162 A to Iwata et al.*

* cited by examiner

*Primary Examiner*—Mohammad M Ali

(57) ABSTRACT

An apparatus for the efficient cooling of produce directed to the cooling of freshly picked produce in containers on pallets. The apparatus has a first opening for the entrance of stacks of containers to be moved through cooling enclosure. The stacks of containers are moved through to a first cooling area wherein the containers are exposed to cooling air provided in a first direction. The stacks of containers are then moved through to a second cooling area wherein the containers are exposed to cooling air in a second direction. Isolation of the containers and routing of the air flow is supplemented with air inflatable seals which abut the containers. A method for the efficient cooling of produce utilizing an apparatus as described.

9 Claims, 17 Drawing Sheets

HIGH EFFICIENCY APPARATUS AND METHOD FOR COOLING PRODUCE

CROSS REFERENCE TO RELATED APPLICATIONS

This application claims priority to Provisional U.S. Application No. 60/627,388 filed on 11/12/2004 to Hawkins, which is hereby incorporated in its entirety.

BACKGROUND

1. Field of the Invention

This invention relates to refrigeration and specifically to the efficient cooling of freshly picked vegetables from the field.

2. Description of Related Art

When produce, such as strawberries, cauliflower, cabbage, and the like, is harvested, workers in the field will pack the produce in cartons. These cartons or boxes are typically rectangular in shape and normally have side openings for facilitating holding of the cartons. Typically the cartons are stacked on pallets and the stacked cartons are in turn then transferred to a flat bed truck or other transportation means to be shipped to a distribution point.

The shelf life of most produce is a function of how quickly the field heat can be removed from the produce once it has been harvested. If considerable time lapses from the time of harvesting to the time of initial cooling down of the produce, the overall shelf life at a retail store is substantially reduced. Any system which will speed up the process of pre-cooling or removing the field heat from the produce after harvesting, or which will increase the efficiency or reliability of machinery involved in such cooling, will have significant economic benefit.

In U.S. Pat. No. 4,474,020, to Freeman, a cooling chamber for drawing down freshly picked and field warmed vegetables is disclosed. A group of individual pallets loaded with rectangular cartons of produce are placed in the field on a transport chassis and brought to the vicinity of the cooling chamber where they are simultaneously unloaded by a multi-pallet forklift truck. The chamber receives this multi-pallet load through an open door and a rear seal conforms to the periphery of the load to define a warm air return plenum. The main chamber door is closed to define a high pressure cool air plenum. Circulation of forced and cooled air occurs for rapid drawing down of the palletized load to a curing temperature.

In U.S. Pat. No. 4,736,592, Ohling, an apparatus for directing cool air to stacks of containers holding freshly harvested produce to remove field heat is disclosed. The apparatus includes a housing having a suction fan for blowing air through an air cooler into a plenum from which the cool air passes through the containers of produce. The direction of the airflow is selectable by moving damper devices relative to the housing.

A drawback of the prior art devices mentioned above is that the containers must be loaded and removed from the same entrance door area. Another drawback is that the devices are not readily adapted to work with differing sizes of pallets or differing sizes of stacks on pallets. A drawback of the Ohling device is that the change in the direction of airflow is accomplished with the use of dampers, which introduce a reliability risk and a maintenance cost.

What is called for is an apparatus and method for the cooling of produce which allows for high volume through put, changes in direction in cooling air flow with a high reliability system, and seals which allow for sufficient latitude in container and pallet size and quantity to accommodate today's differing demands.

SUMMARY

An apparatus for the efficient cooling of produce directed to the cooling of freshly picked produce in containers on pallets. The apparatus has a first opening for the entrance of stacks of containers to be moved through cooling enclosure. The stacks of containers are moved through to a first cooling area wherein the containers are exposed to cooling air provided in a first direction. The stacks of containers are then moved through to a second cooling area wherein the containers are exposed to cooling air in a second direction. Isolation of the containers and routing of the air flow is supplemented with air inflatable seals which abut the containers. A method for the efficient cooling of produce utilizing an apparatus as described.

DETAILED DESCRIPTION

Figure 1:
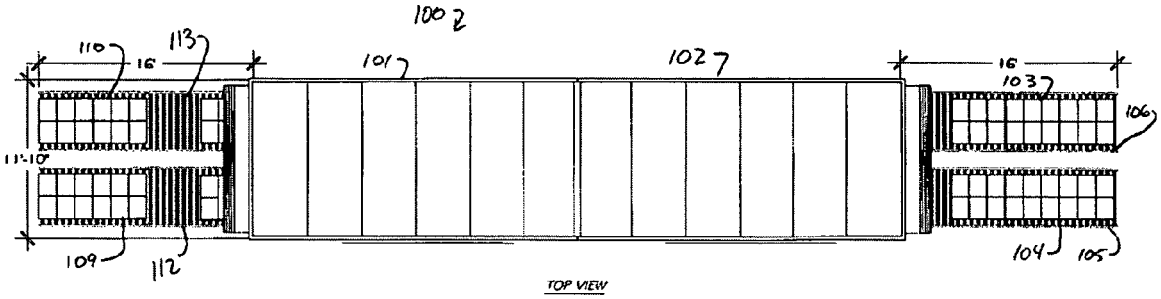
FIG. 1 is a top view of a two module apparatus according to some embodiments of the present invention.
Figure 2:
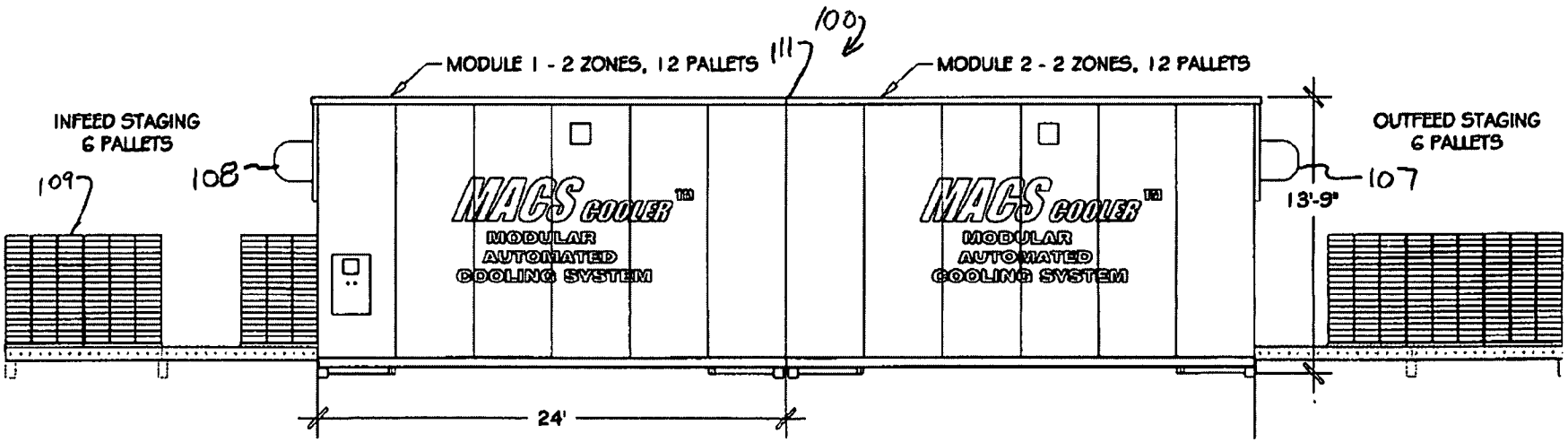
FIG. 2 is a side view of a two module apparatus according to some embodiments of the present invention.

FIGS. 1 and 2 are a top and side view, respectively, of a two module cooling apparatus 100 according to some embodiments of the present invention. In some embodiments of the present invention, a first module 101 and a second module 102 are linked front to back at center joint 111. The cooling apparatus is adapted to receive pallets of cartons of produce via two infeed conveyors 112, 113. Typically, using strawberry cartons as an example, the pallets will be 40 inches wide and will have 108 cartons per pallet. Typically, the height of the cartons on the pallets will be 72 inches high. The cooling apparatus is not constrained by these dimensions and can accommodate variation in the sizes of the fed pallets and stacks as will be described below.

In typical usage, pallets 109, 110 will be fed in to the first module 101 via the infeed conveyors 112, 113. Pallets may be fed in groups of three per conveyor. A roll up door 108 is opened to allow the conveyors to move the produce into the first zone of the first module 101. After the pallets have been moved into the first zone of the first module, the roll up door 108 is lowered. After cooling, the produce leaves the cooling apparatus 100 through a roll up door 107. As seen in FIG. 2, pallets 103, 104 of cooled produce exits the cooling apparatus on outfeed conveyors 105, 106. Should the outfeed conveyors feed into a cooled area no doors may be required at the exit end of the apparatus.

Figure 3:
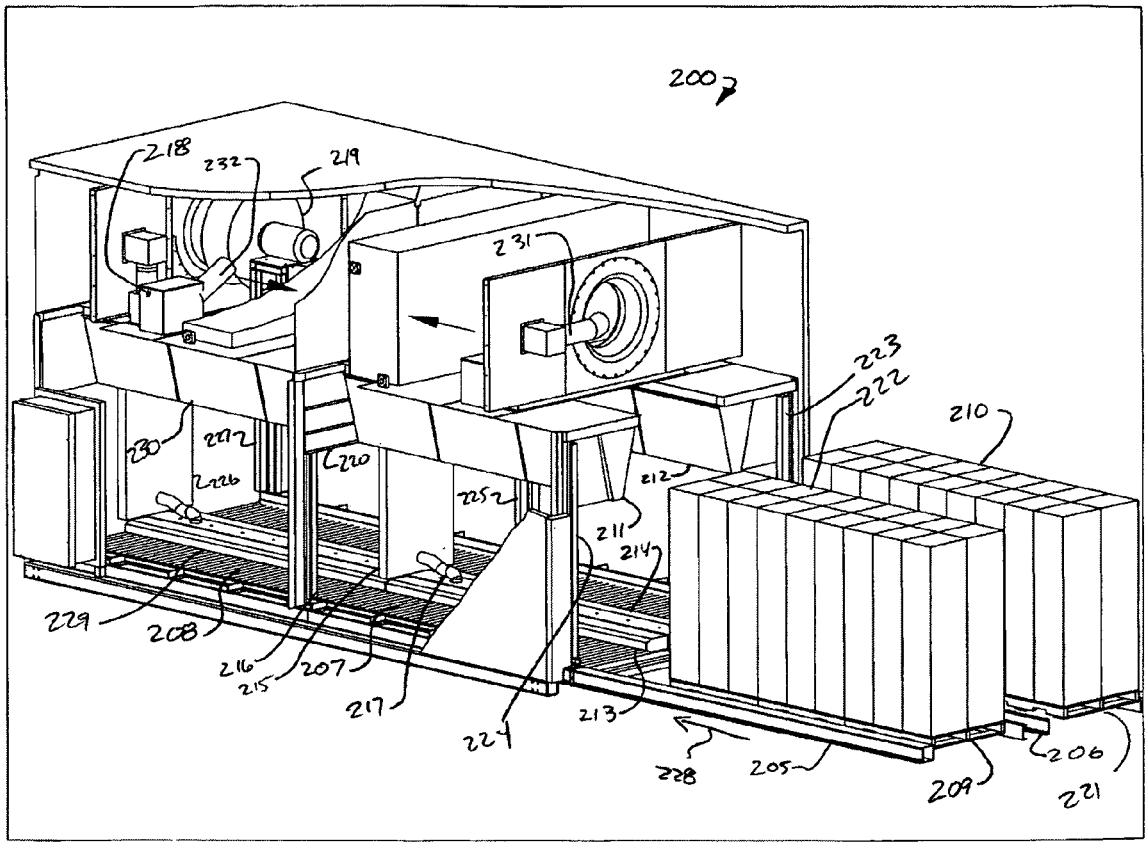
FIG. 3 is a partial cutaway view of an apparatus according to some embodiments of the present invention.

FIG. 3 is a partial cutaway view of a module 200 according to some embodiments of the present invention. In some embodiments of the present invention the module 200 has two zones 207, 208. Each of the zones 207, 208 is of sufficient size to accept sets of three pallets 209, 221 of cartons 210, 222 of produce. The first zone is adapted to cool the produce by providing an air flow in a first direction, while the second zone is adapted to cool the produce by providing an air flow in a second direction.

A first set of pallets 209 are moved along a first infeed conveyor 205 to transport a first plurality of produce cartons 222 into the first zone 207. A second set of pallets 221 are moved along a second infeed conveyor 206 to transport a second plurality of produce cartons 210 into the first zone 207. Typically both of the sets of pallets will be moved into the first zone simultaneously. The conveyor system may have an automated drive system in some embodiments. The pallets are moved into the first zone 207 and may substantially fill the first zone 207 along the length of the first zone 207 in the feed direction 228.

In some embodiments of the present invention, each portion of the conveyor system in each zone, and along each side of the zone, may have an independent drive system. The independent drive system may be coordinated such that the entire conveyor system works together to move pallets simultaneously. The conveyor system may be controlled by an electronic control system which implements the functionality just described. In addition, the electronic control system may have sensors incorporated which confirm that the inflatable seals are all deflated and withdrawn away from the cartons prior to allowing the conveyance of pallets by the conveyor system. In some embodiments, position sensors may be used to determine if the pallets of cartons have been conveyed into the proper position for sealing.

Figure 14:
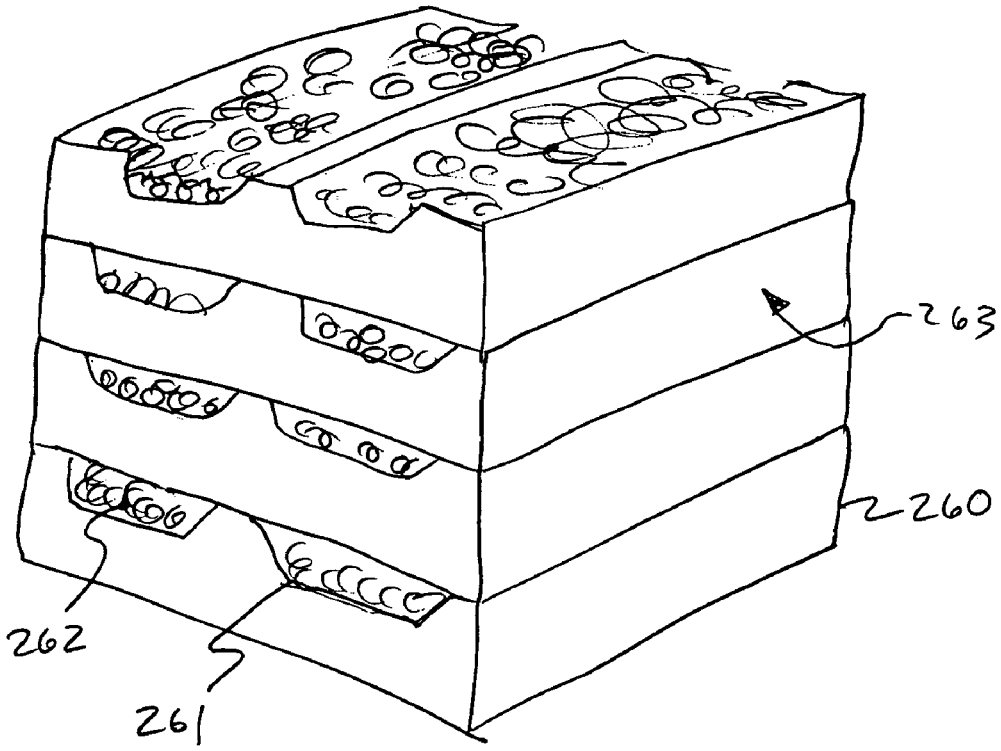
FIG. 14 is a sketch of a stack of produce cartons.

In order to facilitate the cooling of the produce in the cartons, cool air is blown into the space along the sides of the cartons and flows through the cartons across the produce. Typically, as seen in FIG. 14, produce cartons 260 are solid along one surface 263 and the surface opposite. Along the other two side surfaces of the carton, there are openings 261 allowing fluidic access to the produce 262. Thus, cold air can be blown in from the sides in order to cool the produce. Additionally, if the cooling air cools the produce first by entering in one side of the carton, and then, after a period of cooling in that mode, the air flow is reversed, the produce on the other side of the carton will receive cooler air first and the cooling process will be much more even. In order to facilitate the air flow across the produce in the cartons, the cartons are substantially sealed relative to the inner surface of the enclosed zone so that the primary air flow is through the openings 261 and across the produce 262.

Figure 16:
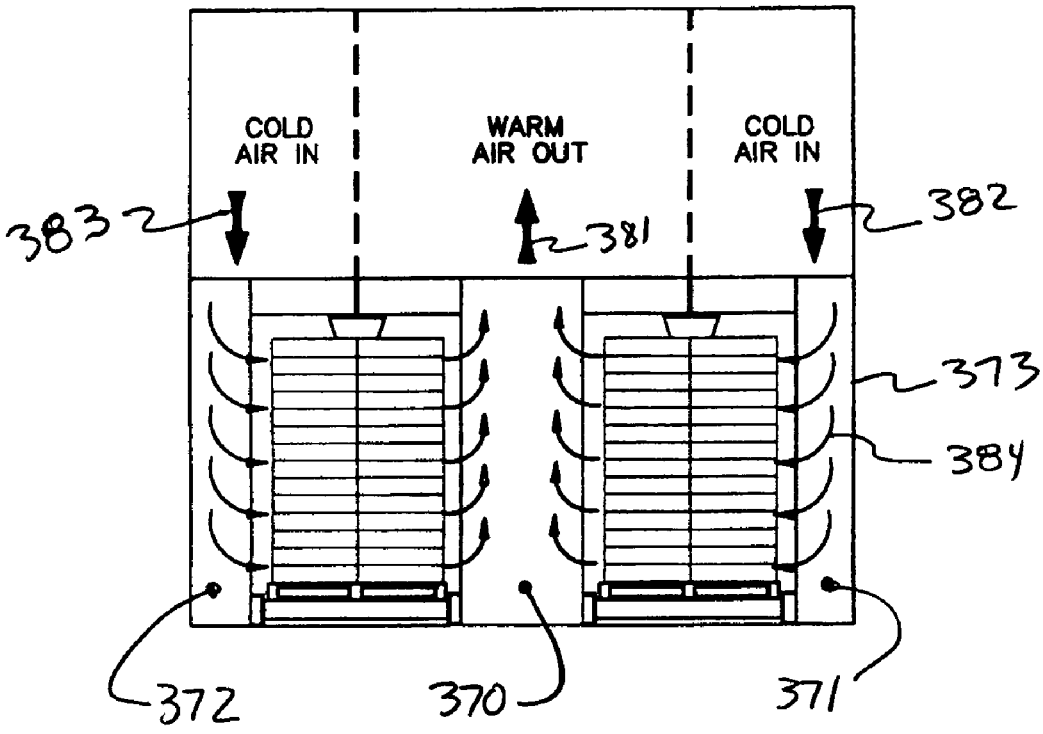
FIG. 16 is a pictorial representation of the air flow in a second zone according to some embodiments of the present invention.
Figure 17:
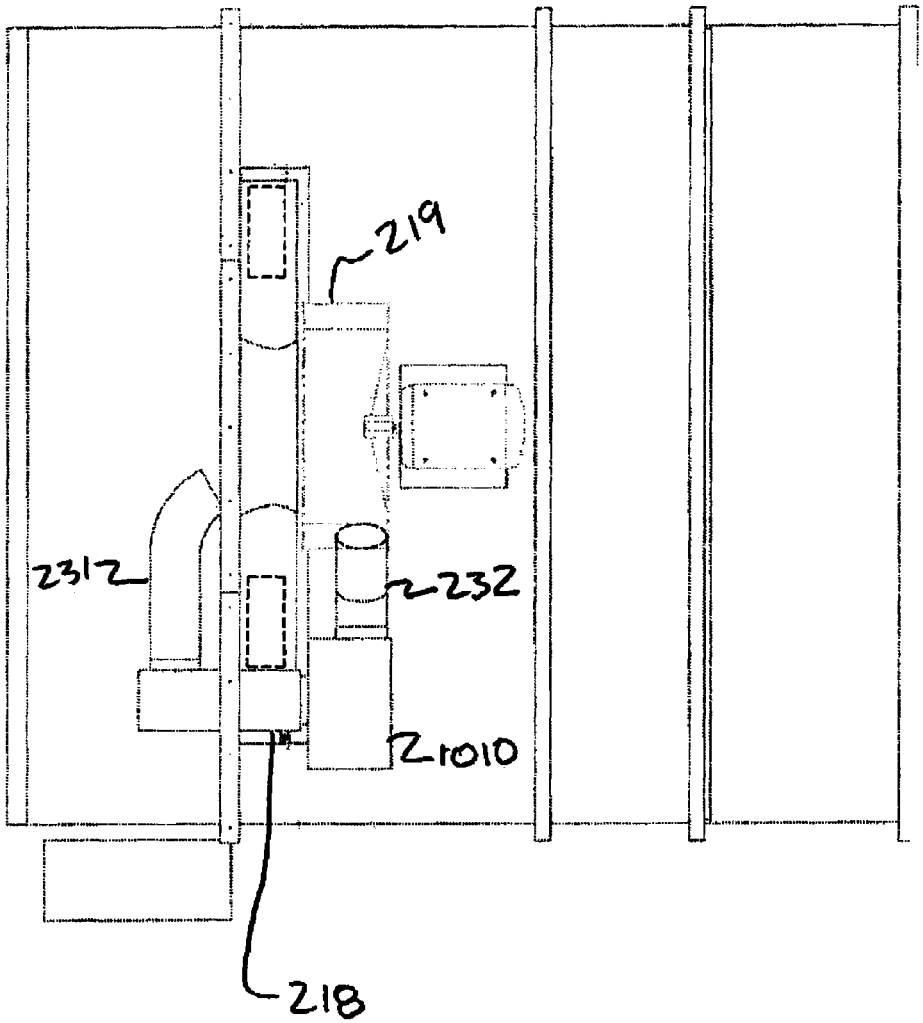
FIG. 17 is a sketch of the positive and negative pressure feeds and the flapper valve for the seal ducts according to some embodiments of the present invention.

Referring back to FIG. 3, a variety of inflatable seals are shown which are used to seal the inner surface of the enclosed area to the cartons, and thus route the cooling airflow through the cartons and across the produce. After the pallets are moved into the first zone 207 and have substantially filled the first zone 207 along the length of the first zone 207 in the feed direction 228, overhead air seals 211, 212 are inflated. The inflatable overhead seals are inflated with air and contact the cartons along their top surface. Inflatable side seals 224, 223, 215, 216, 225 are inflated with air and contact the cartons along their side surfaces at the ends of the sets of cartons. Inflatable lower seals 213, 214 inflate with air and contact the cartons along the lower inside surfaces of the cartons. As seen in FIGS. 16 and 17, these seals work together to divide the zone into regions such that pressurized cold air blown into one of the regions will travel through the side openings 261 in the cartons and across the produce.

In some embodiments of the present invention, all of the inflatable seals for a single zone are fluidically coupled to a single ducting system. This ducting system then is either pressurized or placed into negative pressure by the switching of a flapper valve in the ducting system adjacent to the blower for that zone. The blower is able to provide either positive or negative pressure to ducting system coupled to the inflatable seals depending upon whether the flapper valve couples the ducting system to the positive pressure area downstream from the blower, or to the negative pressure area upstream from the blower.

In some embodiments, the same blower which provides the cooling air also provides the positive and negative pressure for the inflatable seals. As the negative pressure from the upstream side of the blower is used to deflate the inflatable seals, and thus provide clearance between the seals and the produce to allow conveyance of the produce within the apparatus, the blowers will typically be running at all times that the apparatus is in the conveyance mode.

As seen in FIG. 17, the blower 219 provides the pressure for zone in a module. A positive pressure duct 232 is coupled to the blower housing and is a source for positive pressure air. A negative pressure duct 231 has an opening residing in the infeed stream to the blower and provides a source for negative pressure. Both the positive pressure duct 232 and the negative pressure duct 231 meet at a valve box 218. The valve box 218 has an air actuated flapper valve which connects either the positive pressure or the negative pressure to the duct system which pressurizes the air inflatable seals for that zone. This system has the distinct advantage of using a single blower for all cooling processes as well as the sealing in a particular zone. An air filter 1010 is used to filter the positive pressure air from the blower before it reaches the duct system.

The inflatable seals give a distinct advantage of being able to seal stacks of cartons of varying heights and widths. The inflatable seals are deflated when the pallets of cartons enter and exit the zone. The deflated seals may be subjected to negative pressure such that they collapse in an organized manner in order to not interfere with the movement of the cartons prior to and subsequent to cooling cycles. Also, due to their collapsible and expandable nature, the inflatable seals are adapted to seal cartons and pallets within a range of heights and widths. Also, as opposed to stationary flexible seats as used on prior art that must slightly interfere into the space occupied by the cartons in order to provide an air seal, the inflatable seals have the distinct advantage of eliminating all substantial interference with the cartons thereby avoiding hang-ups which are a serious problem with the art.

In some embodiments, the inflatable seals are inflated and deflated using the same blowers that force the cooling air. As seen in FIG. 3, a positive pressure duct 232 routes pressurized air into a valve box 218 which in turn routes pressurized air the inflatable seals in order to seal the inner surface of the enclosure to the cartons and pallet when the flapper valve within is actuated in a first direction. A negative pressure duct 231 routes negatively pressurized air to deflate the inflatable seals such that they collapse and clear the pallets and cartons such that the pallets can be conveyed through the enclosure when the flapper valve within the valve box is actuated in a second direction. In each zone, a positive pressure duct and a negative pressure duct meet in a valve box containing an air actuated flapper valve which will determine whether the ducting system fluidically coupled to the air inflatable seals will receive positive or negative pressure.

After the produce has been sealed in the first zone 207 of the module and cooled with air flowing in a first direction across the produce, the first cooling cycle ends. The inflatable seals are then deflated and with negative pressure collapse and pull away from the cartons. The first and second plurality of produce cartons 210, 222 are then moved along on the conveyor to the second zone 208. Typically, a new set of cartons on pallets will be sent into the first zone behind the produce cartons 210, 222 which have just moved into the second zone 208. Once in the second zone, the first and second plurality of produce cartons 210, 222 are sealed with a set of inflatable seals 230, 226, 229 215, 216 used to seal the second zone. In the second zone 208, the air flow may be in the opposite direction across the produce as in the first zone 207. With subsequent zones set up to force cooling air in a different direction as with the prior zone, the air flow across the produce is reversed without the need for mechanical redirection of the cooling ducts, and without the requirements of maintaining such redirection mechanisms.

Figure 4:
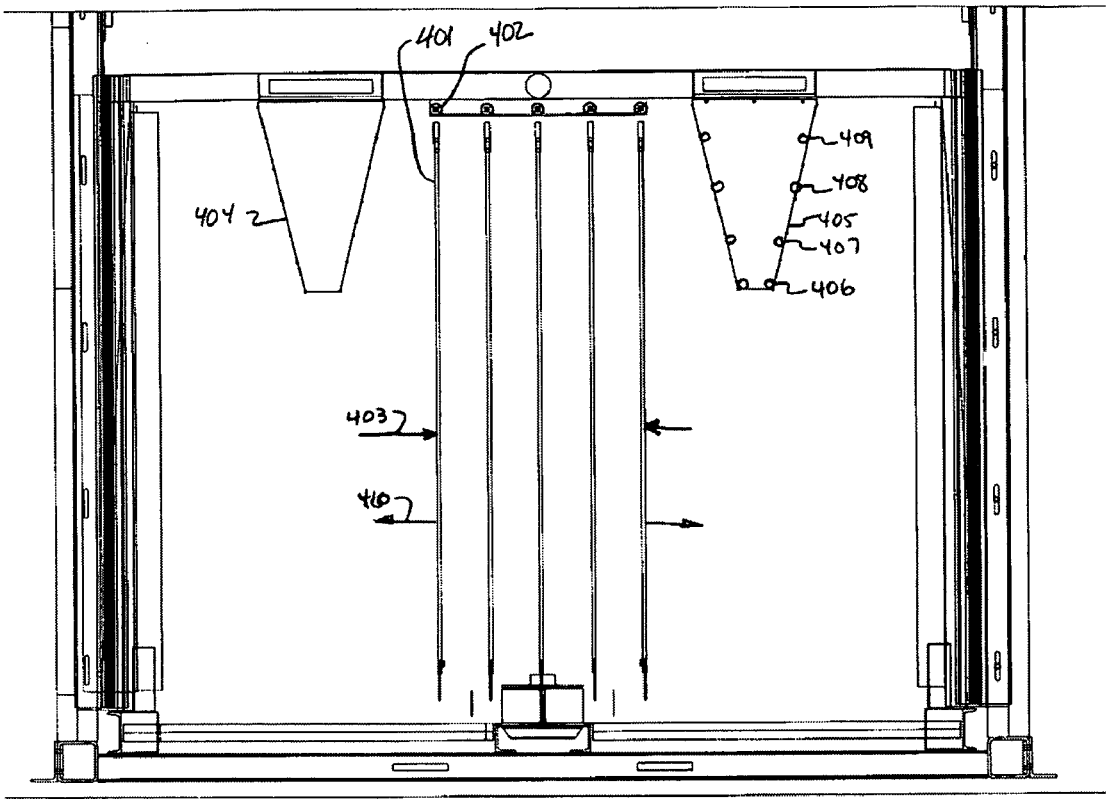
FIG. 4 is an end view of cooling zone according to some embodiments of the present invention.

FIG. 4 illustrates aspects of the inflatable seals according to some embodiments of the present invention. The inflatable center seal 411 (shown without the fabric outer bag portion) has a plurality of frame members 401 suspended from the ceiling of the enclosure. The frame members 401 are suspended using a plurality of rollers 402 such that the inflatable center seal 411 can collapse inward 403 when subjected to negative pressure and is deflated. When subjected to positive pressure, the inflatable center seal expands 410, typically until the seal comes into contact with the corners of the cartons in the cooling area. This configuration allows for the easy sealing, and then unsealing, of the cartons of produce as they are moved into a cooling zone, sealed, cooled, unsealed, and then moved into the next zone (or out of the end of the apparatus) without the hanging up of the seals on the cartons. Additionally, this configuration allows for sealing against not just one width of carton stacks, but instead allows for sealing within a range of widths.

The inflatable overhead seals 404, 405 are also designed to be both adaptable and easy to use. The inflatable overhead seals 404, 405 (shown in their inflated position in FIG. 4) inflate down from the ceiling in order to create a seal along the top of a stack of cartons. When it is desired to unseal the seal, as when the stacks are to be moved, the overhead seals are subjected to negative pressure, which draws the seals upwards and away from the stacks of cartons. A plurality of internal frame members 406, 407, 408, 409 allow the inflatable overhead seals to maintain their structural and positional integrity as they are deflated such that they will be properly positioned to reseal when needed subsequently. Also, this configuration allows the seals to move down from the ceiling until contact is made with the tops of the carton stacks, and allows for sealing against a range of carton heights. This configuration also allows for clearance between the seals and the cartons when needed, as when moving the stacks. FIGS. 8, 9, 10, and 11 illustrate seal designs according to some embodiments of the present invention.

In a typical embodiment, all of the air inflatable seals for a single zone are fluidically coupled to a single ducting system. This ducting system then is either pressurized or placed into negative pressure by the switching of a flapper valve in the ducting system adjacent to the blower for that zone. The blower is able to provide either positive or negative pressure to ducting system coupled to the inflatable seals depending upon whether the flapper valve couples the ducting system to the positive pressure area downstream from the blower, or to the negative pressure area upstream from the blower. Thus, a single command, that to change the position of the flapper valve for a particular zone, can be used to inflate (and seal) or deflate (and withdraw) all of the air inflatable seals in a particular zone.

In some embodiments, the inflatable air seal bags are made from a coated fabric such as a rubberized nylon or similar material. The material need not be fully airtight, but sufficiently wind resistant such that the bags will remain inflated under the available pressure with a leak rate low enough that the seals function properly. In some embodiments, all of the seals in a zone which retract vertically when subjected to negative pressure may have some structural members in common such that they are joined into somewhat of an integrated unit.

In some embodiments, an electronic control system may be used to control the sealing and unsealing of the air inflatable seals. A single control system may be used to control both zones of a two zone module. In some embodiments, a single control system may be used to control all aspects of the conveyance system and sealing system for a single module, or a multi-module apparatus.

Figure 5:
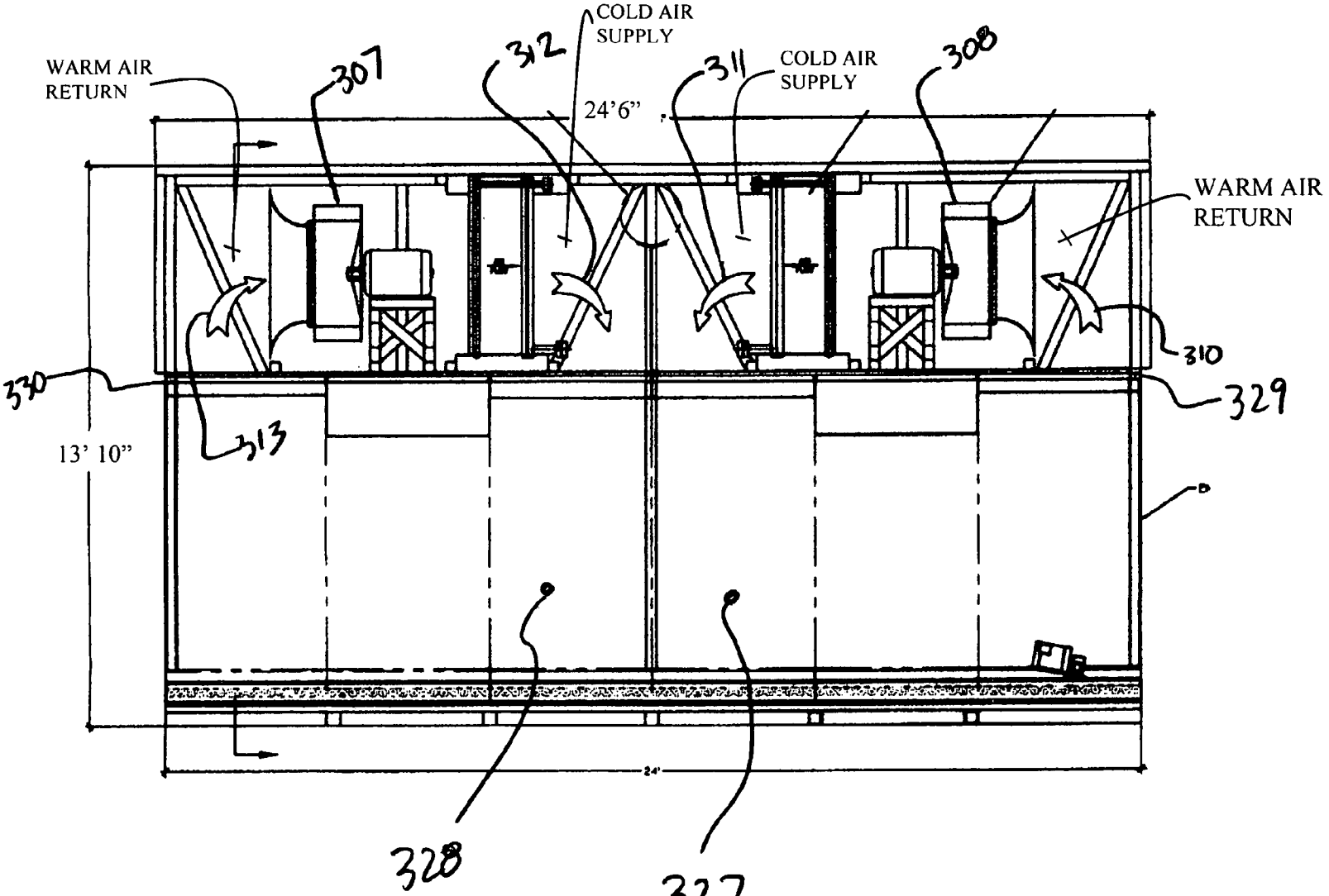
FIG. 5 is a side view sketch illustrating the blower portion of a module according to some embodiments of the present invention.
Figure 6:
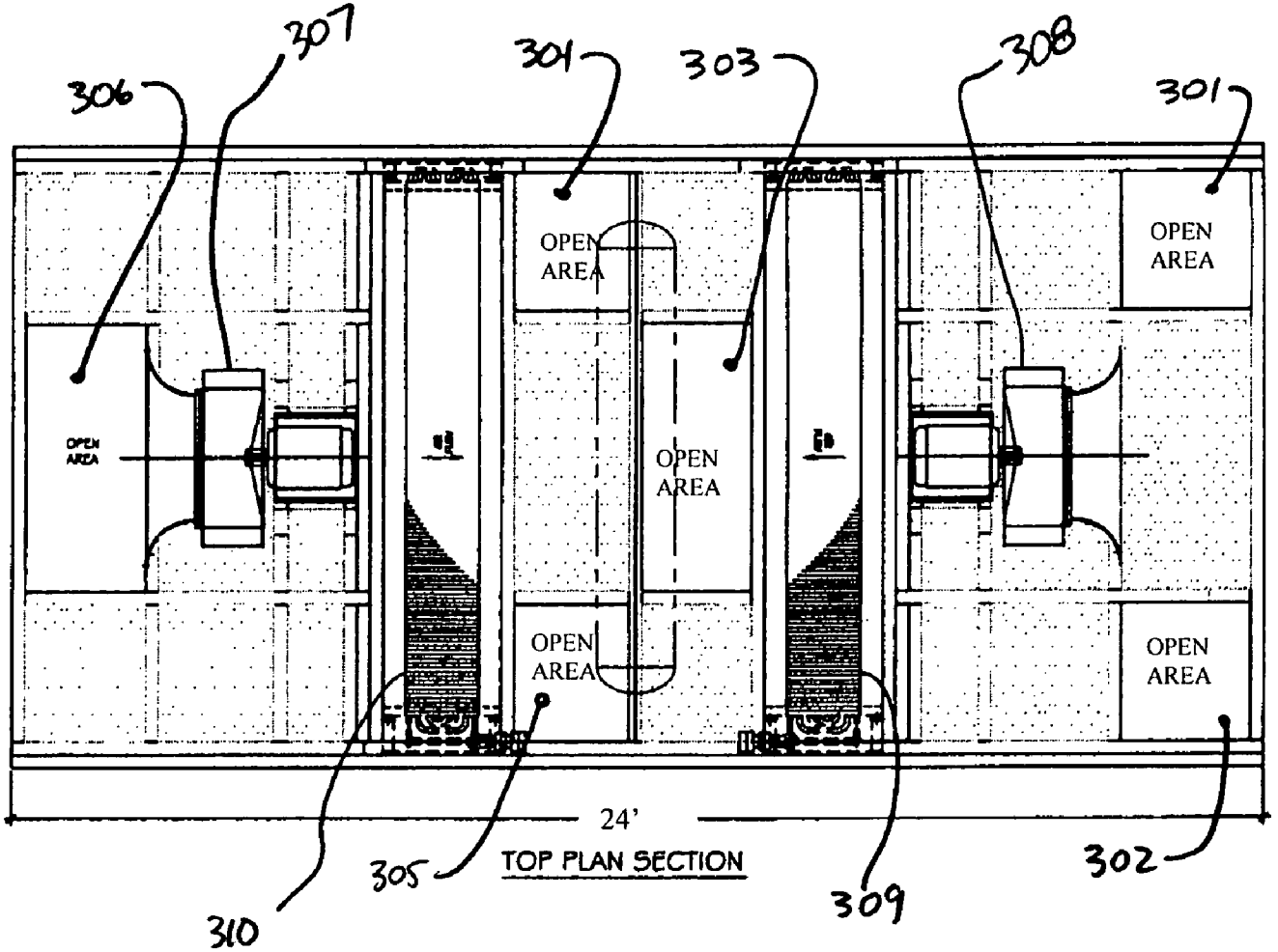
FIG. 6 is a top view sketch illustrating the blower portion of a module according to some embodiments of the present invention.
Figure 7:
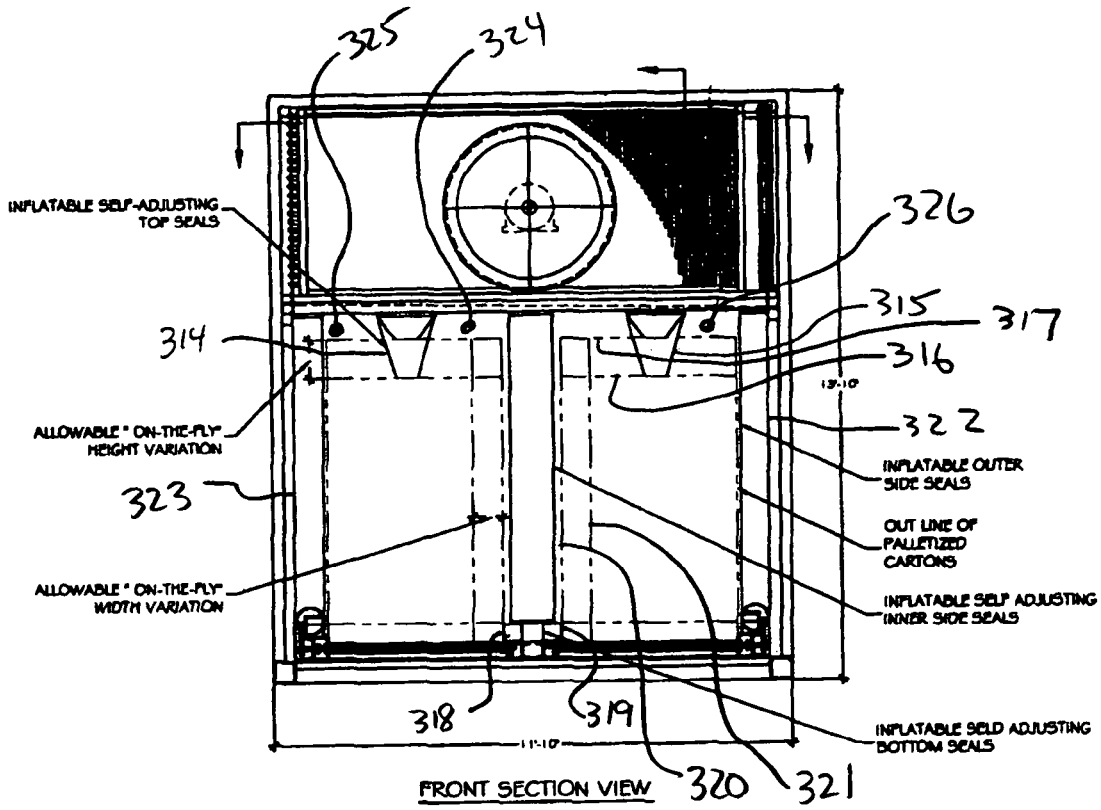
FIG. 7 is an end view sketch illustrating the blower portion of a module according to some embodiments of the present invention.
Figure 8:
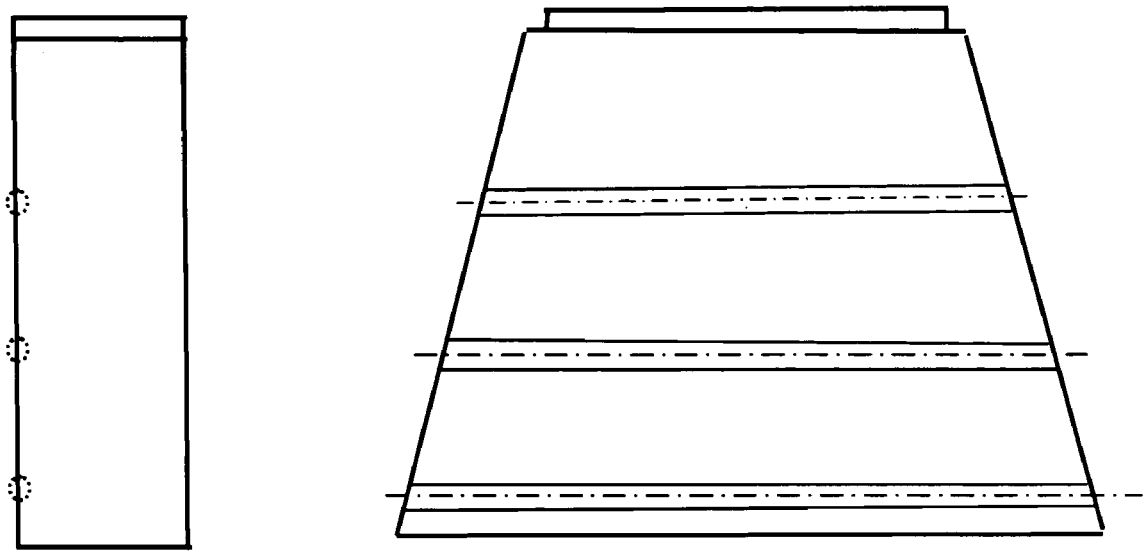
FIG. 8 is a side view of portions of an overhead air bag according to some embodiments of the present invention.
Figure 9:
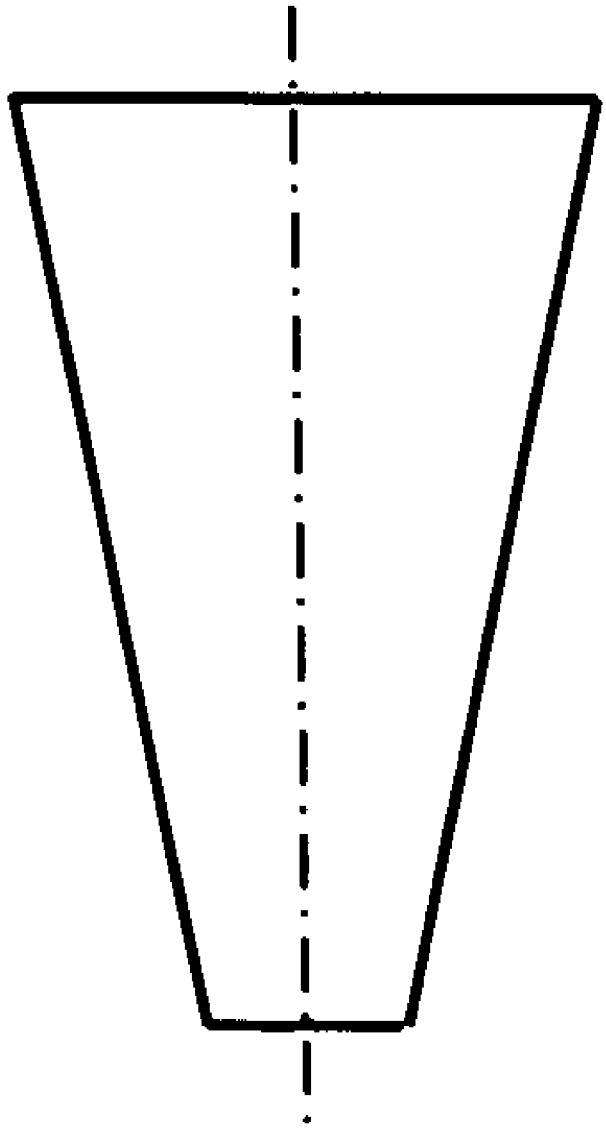
FIG. 9 is an end view of portions of an overhead air bag according to some embodiments of the present invention.
Figure 10:
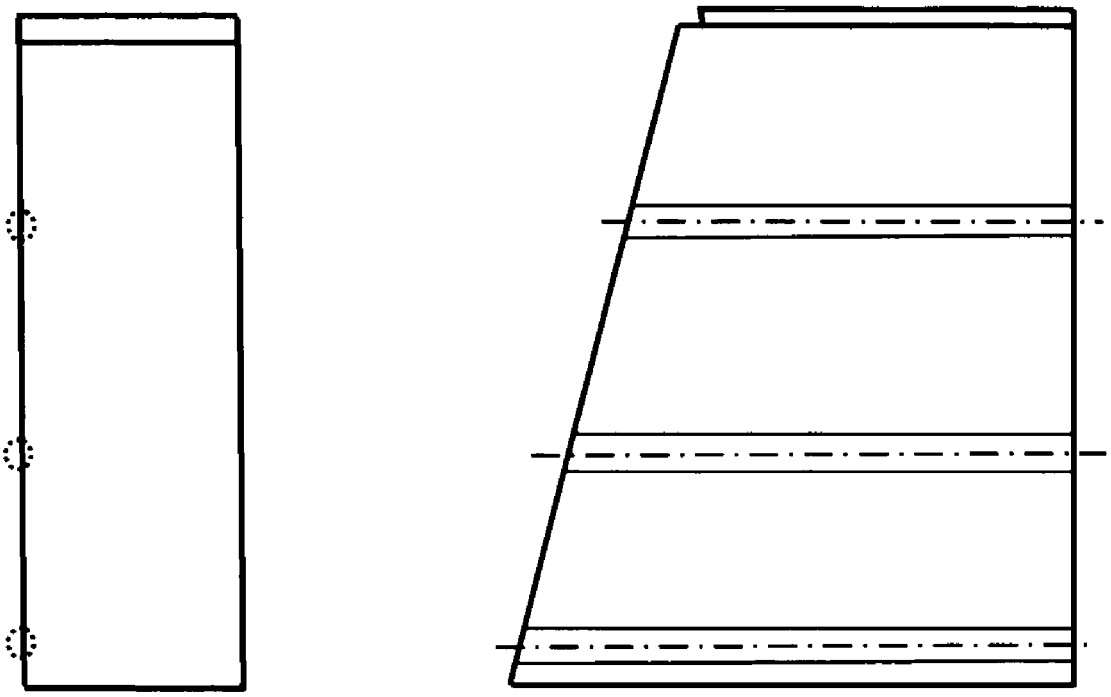
FIG. 10 is a side view of portions of an overhead air bag according to some embodiments of the present invention.
Figure 11:
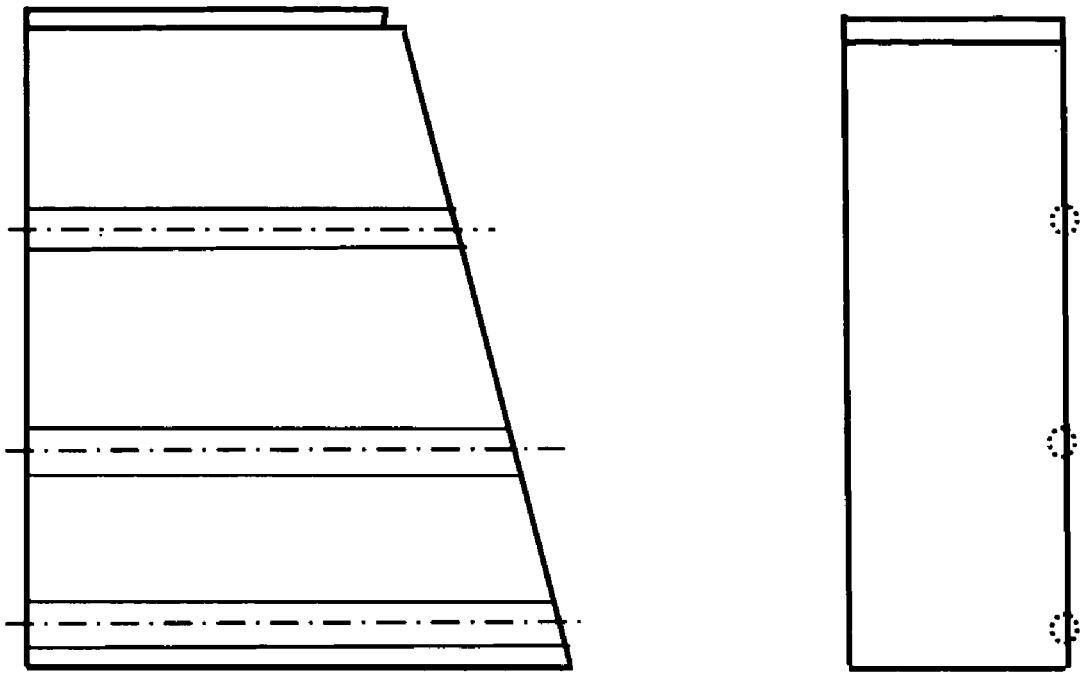
FIG. 11 is a side view of portions of an overhead air bag according to some embodiments of the present invention.

FIGS. 5, 6, and 7 illustrate the forced air cooling and inflatable seals of a two zone module and the regions into which the zones are divided after the inflatable seals have sealed against the cartons in the enclosure according to some embodiments of the present invention. Blower 308 forces air through cooling coils 309 and into the area above enclosure ceiling 329. The enclosure ceiling 329 has an open space 303 which allows for airflow of the cooled air down into the enclosure below. The cooled airflow enters a center region 324 between the cartons on the adjacent conveyors. As the cartons are sealed from overhead by inflatable overhead seals 314, 315 and sealed along their vertical ends by inflatable side seals 322, 323 and at their bottom with the inflatable lower seals 318, 319, the zone is essentially sealed off into three regions 324, 325, 326. The cold air forced in through open space 303 into the center region 324 then flows through the cartons to the outer regions 325, 326. This airflow cools the produce in the cartons, with more cooling occurring in the produce along the centerline of the zone. The air that has traveled into outer regions 325, 326 is then drawn up through the ceiling of the enclosure through outer open spaces 301, 302. This air flow then continues into the blower 308, thus completing an airflow path for the first zone 327.

Once the produce has been exposed to the appropriate length of cooling with the first air flow direction, the seals are deflated and the pallets in the first zone 327 are moved into the second zone 328 where they are sealed in using the inflatable seals similarly to the first zone. In the second zone 328, the blower 307 forces air through the cooling coils 310. The cooled air flows down through outer open spaces 304, 305 into regions on the outer periphery of the cartons. The positive pressure of the airflow forced the cooling air across the produce, this time from the outside regions toward the center region. The air then travels up through the center open space 306 and back into the blower 307, thus completing an airflow cycle for the second zone. The produce has been cooled from both sides, which is desirable to cool the produce in an even manner. The air flow direction was changed across the produce without the need for heavy air flow dampers or other equipment.

Figure 15:
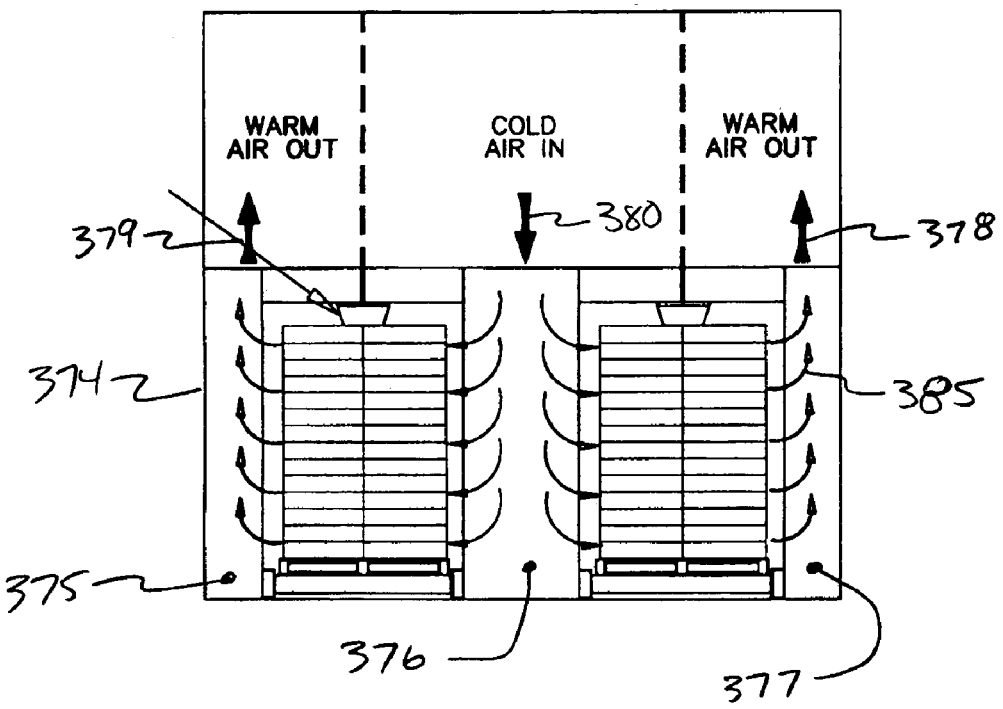
FIG. 15 is pictorial representation of the air flow in a first zone according to some embodiments of the present invention.

FIGS. 15 and 16 are pictorial representations of the air flow regimens described above. The first zone 327 described above is represented in FIG. 16 as a section 374 of the apparatus wherein the cold air 380 flows in through the ceiling into the center region 376. As the pallets and cartons have been substantially sealed with inflatable seals, the air flows 385 substantially across the produce through the cartons into the outside regions 375, 377. The warmer air that has been used for cooling then flows 378, 379 back into the ceiling to complete the airflow cycle as previously described.

The second zone 328 described above is represented in FIG. 16 as a section 373 of the apparatus wherein the cold air 382, 383 flows in through the ceiling into the outside regions 371, 372. As the pallets and cartons have been substantially sealed with inflatable seals, the air flows 384 substantially across the produce through cartons into the center region 370. The warmer air that has been used for cooling then flows 381 back into the ceiling to complete the airflow cycle as described above.

FIG. 7 illustrates a range of pallet widths and stack heights that can be accommodated by the inflatable seals according to some embodiments of the present invention. The inflatable overhead seals 314, 315 can accommodate a range of stack heights 316-317 and still maintain the seal necessary for proper operation of the cooling apparatus. As the inflatable overhead seals 314, 315 are deflated as the stack is moved into the zone, the deflation involves negative pressure and pulls the entire seal up towards the ceiling of the enclosure. As the seal is re-inflated, it may make appropriate contact through a range of heights, thus accommodating a range of stack heights. A similar situation is seen with regard to pallet widths and the inflatable lower seals. A range of pallet widths 320-321 may be accommodated by the inflatable lower seal 319. As the inflatable lower seal 319 is deflated as the stack is moved into the zone, the deflation involves negative pressure and pulls the entire seal towards the center of the enclosure. As the seal is re-inflated, it may make appropriate contact through a range of widths, thus accommodating a range of pallet widths.

Figure 12:
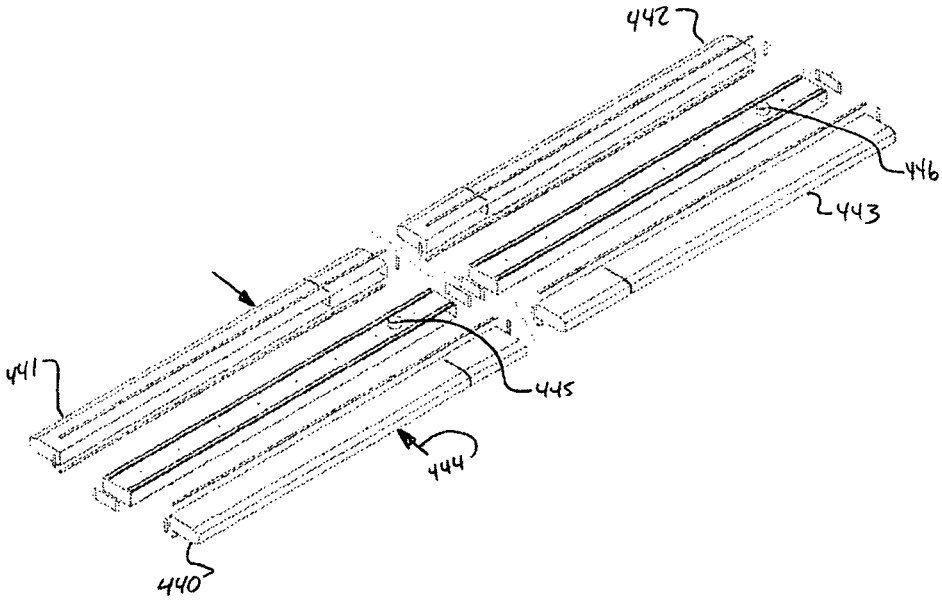
FIG. 12 is a perspective view of portions of an expandable floor seal according to some embodiments of the present invention.

FIG. 12 is an exploded view of aspects of the air inflatable lower seals for a two zone module according to some embodiments of the present invention. The air inflatable lower seals 440, 441, 442, 443 are shown in their inflated positions. The air inflatable lower seals 440, 441, 442, 443 are physically attached and fluidically coupled to the lower center ducts 445, 446. When the lower center ducts are subjected to negative pressure, the air inflatable lower seals 440, 441, 442, 443 withdraw in a direction 444 towards the center of the apparatus. When subjected to positive pressure, the air inflatable lower seals 440, 441, 442, 443 move outwards until they come into contact with and seal against the bottoms edges of the cartons or pallets on the conveyor system.

Figure 13:
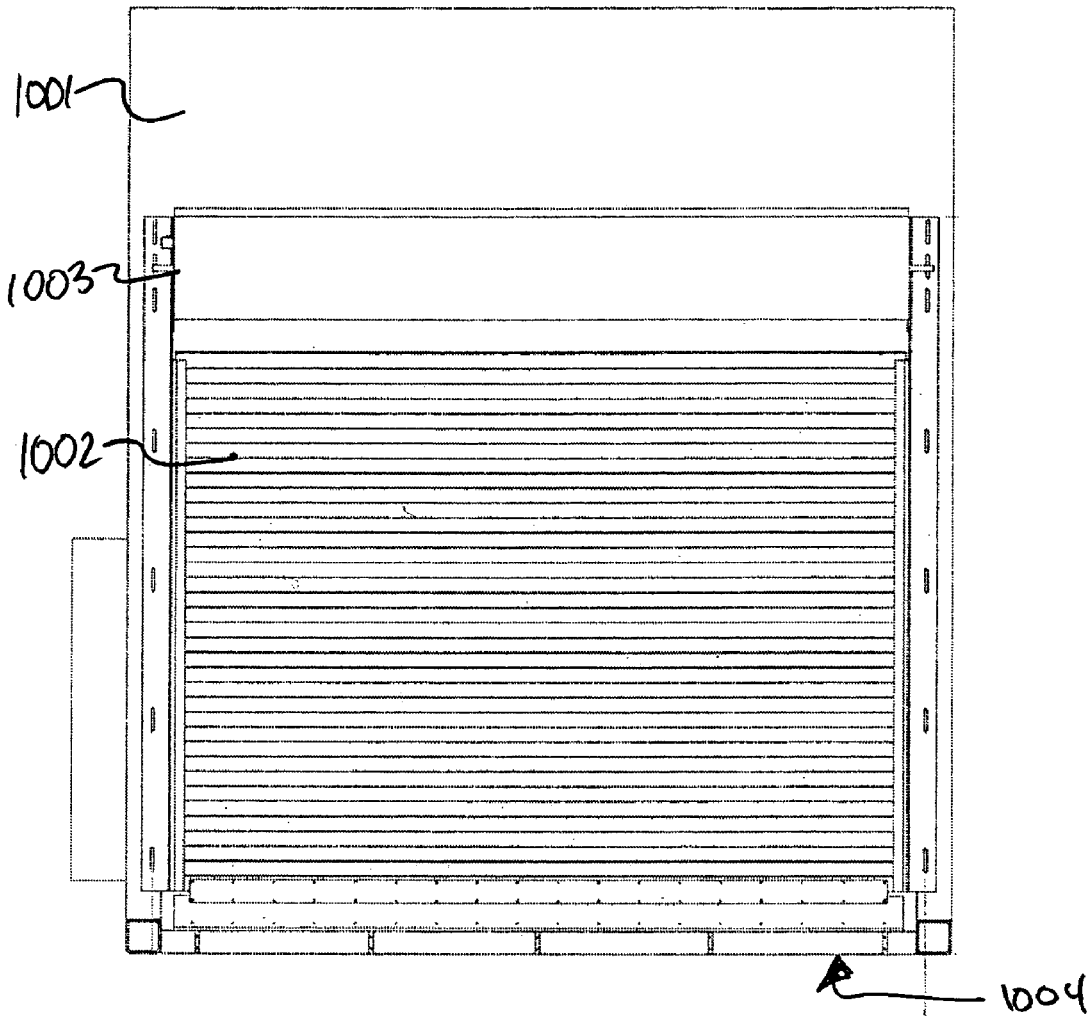
FIG. 13 is an end view of a module showing a door according to some embodiments of the present invention.

FIG. 13 is an end view of a module showing a inlet door 1002 along the front side 1001 of a module. The inlet door rolls up into a storage unit 1003. The module sits on a bottom surface 1004 on the ground or other area.

In some embodiments of the present invention, the apparatus may have features to allow transportation without the need to be load up onto a tractor trailer, which may require a crane or significant lifting and pulling. In some embodiments, the apparatus is of sufficient width that a tractor trailer may be backed through it such that the rear wheels of the trailer are backed out of the apparatus after backing through it. The apparatus may then be jacked up and attached to the tractor trailer with the bottom of the apparatus sitting below the bed of the tractor trailer. The air inflatable seals which interfere with this operation may be removed before the tractor trailer is driven through the apparatus. Much of inflatable seal portion may remain in the apparatus and be adequately restrained.

After the apparatus has been jacked up into place and attached to the tractor trailer, the apparatus may be moved to a new location. After arrival in the next location, the apparatus may be lowered back down to the ground and the tractor trailer may be driven back through the apparatus.

A method for the cooling of produce comprising conveying two side by side sets of three pallets of produce cartons into a first enclosed zone. The sets of pallets are conveyed into a first zone while the air inflatable seals for the zone are subjected to negative pressure and are retracted. The pallets are conveyed into the first zone until they trip a position sensor that confirms that they have reached the proper position along the conveyor for sealing in the first zone.

The flapper valve is then switched to place the duct system for the air inflatable seals into a positive pressure mode. The air inflatable seals then inflate and extend out to make a seal with the palletized cartons of produce, dividing the zone into sealed air spaces. Cooling air fed by a blower is fed into one or more of the sealed air spaces in such a manner that it is forced across the produce, thus cooling the produce. The air forced across the produce travels into another air space that is subjected to lower pressure and returns up to the blower.

In an example embodiment using strawberries, the inlet air fed into the air spaces is at 27 F. The air temperature after the air has crossed the produce is in the range of 33 F. Using a four zone, two module apparatus, the produce remains in this first zone with a first air direction for 10-12 minutes. After the time period for cooling in this zone has expired, the inflatable air seals are subjected to negative pressure by the air actuation of the flapper valve in the valve box.

The two sets of three pallets are then conveyed into a second zone. Once the appropriate location for the second zone has been reached by the pallets, the conveyor stops, and the air inflatable seals are re-inflated. Typically, there are another set of pallets behind the first which take the space in the first zone vacated by the pallets that have moved into the second zone. In the second zone, the air flow is configured such that the air flow across the produce is in the opposite direction as was the air flow across the produce in the first zone. The temperatures and the times for cooling in this zone are typically the same as used in the first zone.

The cooling cycles and time are repeated as the produce travels through all four zones of the two modules. At the end of the final cycle, the produce will have been cooled for approximately 48 minutes and the produce will have reached the target temperature of 32-34 F. The cooled produce is now ready for transport.

As evident from the above description, a wide variety of embodiments may be configured from the description given herein and additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

I claim:

1. An apparatus for the cooling of produce, said apparatus comprising:

a first enclosure having an access opening to allow containers of produce to be placed therein in two rows with the rows spaced from each other to form a first central space and with the rows being spaced from the inner surface of the first enclosure to form two first outer spaces;

a first plurality of air inflatable seals adapted to seal the inner surface of said first enclosure against the containers of produce to be placed therein, thus substantially sealing the first central space and the two first outer spaces;

first forced air refrigeration equipment, said first forced air refrigeration equipment comprising a first blower, said first forced air refrigeration equipment adapted to force refrigerated air into said two first outer spaces and to remove air from said first inner space;

a second enclosure, said second enclosure connected to said first enclosure along a continuous conveyor for containers of produce, said second enclosure comprising:

an access opening to allow containers of produce to be placed therein in two rows with the rows spaced from each other to form a second central space and with the rows being spaced from the inner surface of the second enclosure to form two second outer spaces;

a second plurality of air inflatable seals adapted to seal the inner surface of said second enclosure against the containers of produce to be placed therein, thus substantially sealing the second central space and the two second outer spaces;

second forced air refrigeration equipment, said second forced air refrigeration equipment comprising a second blower, said second forced air refrigeration equipment adapted to force refrigerated air into said second inner air space and to remove air from said two second outer spaces;

a first flapper valve;

a first pressurized air inlet, said first pressurized air inlet fluidically coupled to the positive air pressure side of said first blower at one end and said first flapper valve at a second end;

a first negative pressure air inlet, said first negative pressure air inlet fluidically coupled to the negative air pressure side of said first blower at one end and said first flapper valve at a second end; and a first ducting system, said first ducting system fluidically coupled to said first plurality of air inflatable seals, said first ducting system fluidically coupled to said first flapper valve.

2. The apparatus of claim 1 further comprising:

a second flapper valve;

a second pressurized air inlet, said second pressurized air inlet fluidically coupled to the positive air pressure side of said second blower at one end and said second flapper valve at a second end, a second ducting system, said second ducting system fluidically coupled to said second plurality of air inflatable seals, said second ducting system fluidically coupled to said second flapper valve.

3. The apparatus of claim 2 further comprising:

a second negative pressure air inlet, said second negative pressure air inlet fluidically coupled to the negative air pressure side of said second blower at one end and said second flapper valve at a second end.

4. The apparatus of claim 2 wherein said first plurality of air inflatable seals are adapted to seal when fluidically coupled to pressurized air.

5. The apparatus of claim 4 wherein said first plurality of air inflatable seals are adapted to retract when fluidically coupled to negative pressure air.

6. The apparatus of claim 3 wherein said second plurality of air inflatable seals are adapted to retract when fluidically coupled to pressurized air.

7. The apparatus of claim 6 wherein said second plurality of air inflatable seals adapted to retract when fluidically coupled to negative pressure air.

8. The apparatus of claim 5 further comprising a plurality of position sensors, said position sensors adapted to sense the position of said first plurality of air inflatable seals.

9. The apparatus of claim 8 further comprising an electronically controlled conveyance system, said electronically controlled conveyance system adapted to convey containers of produce through said first enclosure, said electronically controlled conveyance system adapted to preclude conveyance if said position sensors sense that any of said first plurality of air inflatable seals are not retracted.

* * * * *